US007775738B2

(12) United States Patent
Darcy

(10) Patent No.: US 7,775,738 B2
(45) Date of Patent: Aug. 17, 2010

(54) VEHICLE BARRIER SYSTEM

(76) Inventor: Daniel T. Darcy, 804 Old Plymouth St., Halifax, MA (US) 02338

( * ) Notice: Subject to any disclaimer, the term of this patent is extended or adjusted under 35 U.S.C. 154(b) by 994 days.

(21) Appl. No.: 11/491,625

(22) Filed: Jul. 24, 2006

(65) Prior Publication Data

US 2009/0250674 A1 Oct. 8, 2009

Related U.S. Application Data

(63) Continuation-in-part of application No. 11/054,257, filed on Feb. 9, 2005, now abandoned.

(60) Provisional application No. 60/621,374, filed on Oct. 22, 2004.

(51) Int. Cl.
*E01F 13/00* (2006.01)

(52) U.S. Cl. ..... 404/6; 256/13.1

(58) Field of Classification Search ..... 404/6, 404/9, 10; 256/13.1
See application file for complete search history.

(56) References Cited

U.S. PATENT DOCUMENTS

| | | | | |
|---|---|---|---|---|
| 1,449,518 | A * | 3/1923 | Lawson | 256/13.1 |
| 1,650,093 | A * | 11/1927 | Rank et al. | 404/10 |
| 2,187,556 | A * | 1/1940 | Gill | 256/13.1 |
| D233,219 | S | 10/1974 | O'Donnell | |
| 4,152,871 | A | 5/1979 | Kardash, Jr. | |
| 4,574,523 | A | 3/1986 | Nasatka | |
| 4,576,508 | A | 3/1986 | Dickinson | |
| 4,624,600 | A | 11/1986 | Wagner et al. | |
| 4,705,426 | A | 11/1987 | Perea | |
| 4,752,152 | A | 6/1988 | Crisp et al. | |
| 4,759,655 | A | 7/1988 | Gorlov | |
| 4,818,137 | A | 4/1989 | Gorlov | |
| 4,822,207 | A | 4/1989 | Swahlan | |
| 4,828,424 | A | 5/1989 | Crisp, Sr. | |
| 4,923,327 | A | 5/1990 | Gorlov | |
| 4,979,817 | A | 12/1990 | Crisp, Sr. | |
| 5,134,815 | A | 8/1992 | Pickett | |
| 5,201,599 | A | 4/1993 | Kulp et al. | |
| 5,228,237 | A | 7/1993 | Nasatka | |

(Continued)

FOREIGN PATENT DOCUMENTS

| | | | |
|---|---|---|---|
| DE | 3412354 | A1 | 10/1985 |

(Continued)

OTHER PUBLICATIONS

Certification Standard, Test Method for Vehicle Crash Testing of Perimeter Barriers and Gates, Physical Security Division, Office of Physical Security Programs, Bureau of Diplomatic Security, U.S. Department of State, Washington, D.C., SD-STD-02.01, Mar. 2003.

(Continued)

*Primary Examiner*—Raymond W Addie
(74) *Attorney, Agent, or Firm*—Iandiorio Teska & Coleman

(57) ABSTRACT

A modular vehicle barrier system includes a reaction mass for installation in the earth; at least one post immovably anchored in the reaction mass and extending upwardly therefrom; the reaction mass having a forward member for confronting and compressing the surrounding earth and absorbing energy from the impact of the vehicle with the post.

24 Claims, 14 Drawing Sheets

U.S. PATENT DOCUMENTS

| | | | | |
|---|---|---|---|---|
| 5,288,164 | A | 2/1994 | Nasatka | |
| 5,466,088 | A | 11/1995 | Nasatka | |
| 5,639,178 | A | 6/1997 | Wilson et al. | |
| 5,829,913 | A * | 11/1998 | Puckett | 404/6 |
| 6,099,200 | A | 8/2000 | Pepe et al. | |
| 6,338,594 | B1 | 1/2002 | Adler et al. | |
| 6,413,009 | B1 | 7/2002 | Duckett | |
| 6,435,760 | B1 * | 8/2002 | Pettesch | 404/6 |
| 6,623,204 | B2 | 9/2003 | Buehler | |
| 6,669,402 | B1 | 12/2003 | Davis et al. | |
| 6,702,512 | B1 * | 3/2004 | Reale | 404/6 |
| 6,709,190 | B1 | 3/2004 | Partin | |
| 6,805,515 | B2 | 10/2004 | Reale | |
| 6,887,010 | B2 * | 5/2005 | Mayer Rodis | 404/6 |
| 7,118,304 | B2 | 10/2006 | Turpin et al. | |
| 7,128,308 | B2 * | 10/2006 | Marsh et al. | 256/13.1 |
| 7,195,420 | B2 * | 3/2007 | Skalka | 404/6 |
| 7,258,505 | B2 * | 8/2007 | Dehart | 404/6 |
| 7,607,856 | B2 * | 10/2009 | Patel | 404/6 |
| 2002/0150423 | A1 | 10/2002 | Dicke et al. | |
| 2003/0119710 | A1 | 6/2003 | Dicke et al. | |
| 2004/0028469 | A1 | 2/2004 | Dehart | |
| 2004/0033106 | A1 | 2/2004 | Turpin et al. | |
| 2004/0175231 | A1 | 9/2004 | Reale | |
| 2005/0150165 | A1 | 7/2005 | Herwich et al. | |
| 2005/0201829 | A1 | 9/2005 | Dehart | |
| 2005/0220536 | A1 | 10/2005 | Blair et al. | |
| 2006/0018711 | A1 | 1/2006 | Rogers et al. | |
| 2009/0208285 | A1 | 8/2009 | Adler et al. | |

FOREIGN PATENT DOCUMENTS

| | | | |
|---|---|---|---|
| EP | 0 955 414 | A2 | 11/1999 |
| EP | 1 054 108 | A2 | 11/2000 |
| FR | 2057107 | A5 | 4/1971 |
| GB | 2 229 472 | A | 9/1990 |
| JP | 10-176314 | A | 6/1998 |
| JP | 11-61746 | A | 3/1999 |
| JP | 2001295298 | A | 10/2001 |

OTHER PUBLICATIONS

The National Capital Urban Design and Security Plan, NCPC National Capital Planning Commission, Oct. 2002, 89 pages.

Michael Janofsky, "Security Efforts Turning the Capital Into an Armed Camp", The New York Times National, Sunday, Feb. 22, 2004, p. 19.

"Army Field Manuals: Concrete Properties: Figure G-4: Wall and Footing Reinforcement," GlobalSecurity.org, http://www.globalsecurity.org/military/library/policy/army/fm/3-34-343/appg.htm, May 25, 2002, 8 pages.

* cited by examiner

CROSS SECTIONAL VIEW - Barrier Fence

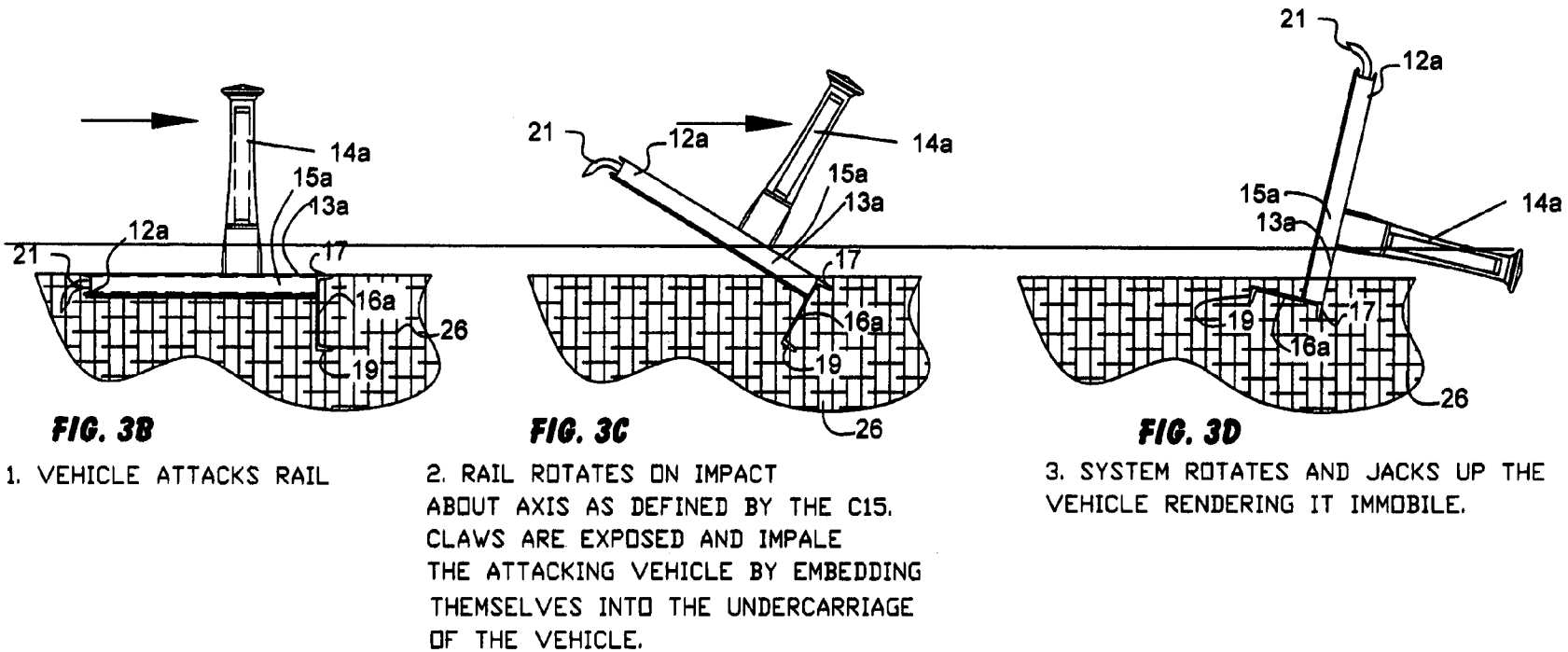
INTENDED DESIGN SEQUENCE OF FUNCTION ON IMPACT - Barrier Fence

VEHICLE BARRIER SYSTEM

RELATED APPLICATIONS

This application is a continuation-in-part application of U.S. patent application Ser. No. 11/054,257, filed Feb. 9, 2005 now abandoned, entitled "Vehicle Barrier System". This application claims benefit of U.S. patent application Ser. No. 11/054,257, filed Feb. 9, 2005 and U.S. Provisional Application No. 60/621,374 filed Oct. 22, 2004, entitled "Assault Vehicle Barrier System" incorporated by reference herein.

FIELD OF THE INVENTION

This invention relates to a vehicle barrier system.

BACKGROUND OF THE INVENTION

With the rise in terrorism there has been a rise in the need for security and protection devices to defend buildings and facilities from attack by assault vehicles such as cars and trucks loaded with explosives. The presently available devices suffer from one or more disadvantages including being generally complex and expensive, and requiring substantial ground preparation, earth moving, utility relocation and construction effort. One of the most popular approaches presently is the use of simple bollards which include steel pipes filled with concrete and embedded into the ground to a depth of 48 inches. These bollards are spaced approximately 40-48 inches on center above the periphery of the facility to be protected. The installation of bollards requires the excavation and disposal of earth by backhoe, or by drilling, approximately 36" diameter holes by 60" deep. The process requires costly underground utility relocation (most utilities are located 36" to 48" below grade). This is a time consuming and costly process in an urban setting. Further, in and around many government buildings there exist underground tunnels for heat, water, sewerage utilities and personal egress which are located within 36" of the top surface. Thus not allowing the installation of bollards in that area. Jersey barriers are also temporarily used to bar entry of unwanted vehicles. Conventional barriers such as those that are selectively extendable and retractable e.g. U.S. Pat. Nos. 4,828,424; 4,705,426 are not sufficient to meet present government specifications such as SD-STD-02.01, Revision A, March 2003. Whether these simpler approaches are used or more complex approaches are used the flexibility of design is severely limited: architectural and aesthetic qualities are generally sacrificed for security.

BRIEF SUMMARY OF THE INVENTION

It is therefore an object of this invention to provide an improved vehicle barrier system.

It is a further object of this invention to provide such an improved vehicle barrier system which requires much less ground preparation.

It is a further object of this invention to provide such an improved vehicle barrier system which is a shallow ground mounted system.

It is a further object of this invention to provide such an improved vehicle barrier system which admits of easy and aesthetic variations in design and appearance.

It is a further object of this invention to provide such an improved vehicle barrier system which permits easy integration of common landscape items such as park benches, bus waiting shelters, vehicular gates, pedestrian gates, street lighting, fountains, civic art and sculpture, trash receptacles, tables, chairs, and other exterior elements which may disguise and increase the vehicle arresting function of the barrier system.

The invention results from the realization that a truly simple and inexpensive yet versatile and effective modular vehicle barrier arresting system can be achieved with a reaction mass for installation in the earth and at least one actuator post extending upward from and immovably anchored to the reaction mass. The reaction mass has a forward member for confronting and compressing the surrounding earth and absorbing energy from the impact of the vehicle with the post.

The subject invention, however, in other embodiments, need not achieve all these objectives and the claims hereof should not be limited to structures or methods capable of achieving these objectives.

This invention features a modular vehicle barrier system including a reaction mass for installation in the earth and at least one post immovably anchored in the reaction mass and extending upwardly therefrom. The reaction mass has a forward member for confronting and compressing the surrounding earth and absorbing energy from the impact of the vehicle with the post.

In a preferred embodiment the reaction mass may extend rearwardly from the post under at least the forward portion of the vehicle for bearing a portion of the weight of the vehicle. The post may or may not be closer to the forward end than the rearward end of the reaction mass. There may be a plurality of spaced posts anchored in the reaction mass. Each post may be made of metal. Each post may be made of metal and filled with concrete. The reaction mass may include a metal framework. The metal framework may include metal members welded together. The post may be made of metal and welded to the framework. The metal framework may be filled with concrete. The metal framework may be filled with concrete in situ. The reaction mass may include a thrust block at its forward end. The thrust block may include a metal core. The thrust block may include a concrete mass extending to confronting virgin earth. The thrust block may include a concrete mass poured in situ. The top of the reaction mass may be below the surface. The top of the reaction mass may be flush with the surface. The system may be accompanied with hardscape environs and the posts may form a part of the hardscape environs. The system may be accompanied with hardscape objects and the posts may be integral with the hardscape objects.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
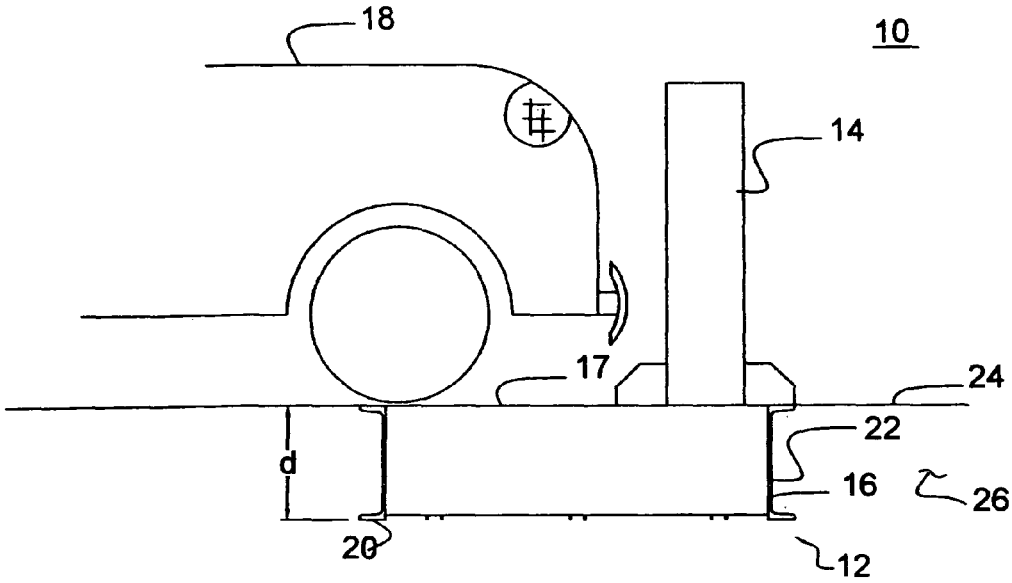
FIG. 1 is schematic side elevational sectional view of a vehicle barrier system according to this invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
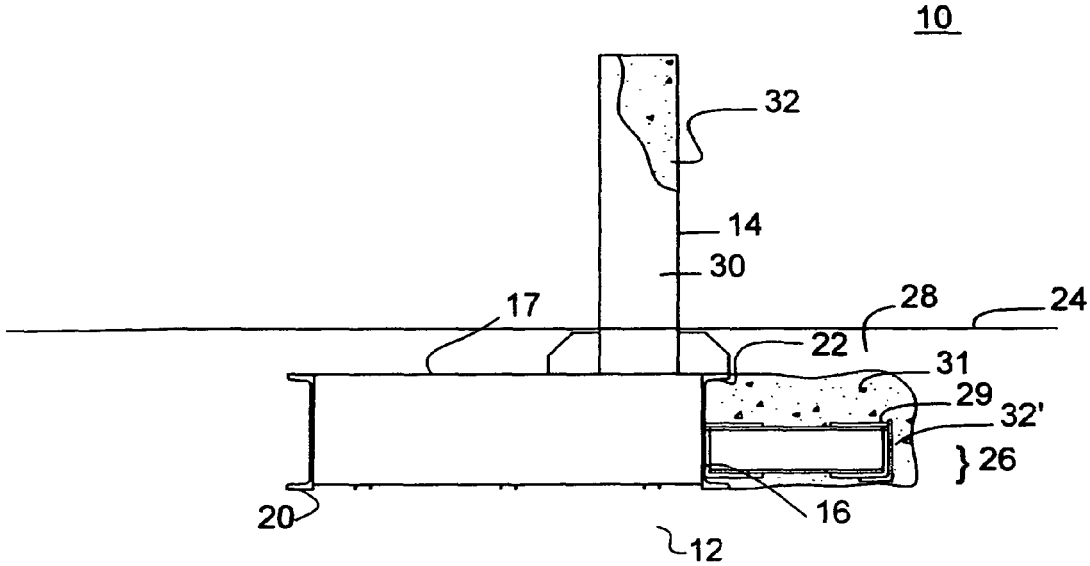
FIG. 2 is a view similar to FIG. 1 with portions broken away showing the addition of a thrust block frame.
Figure 3:
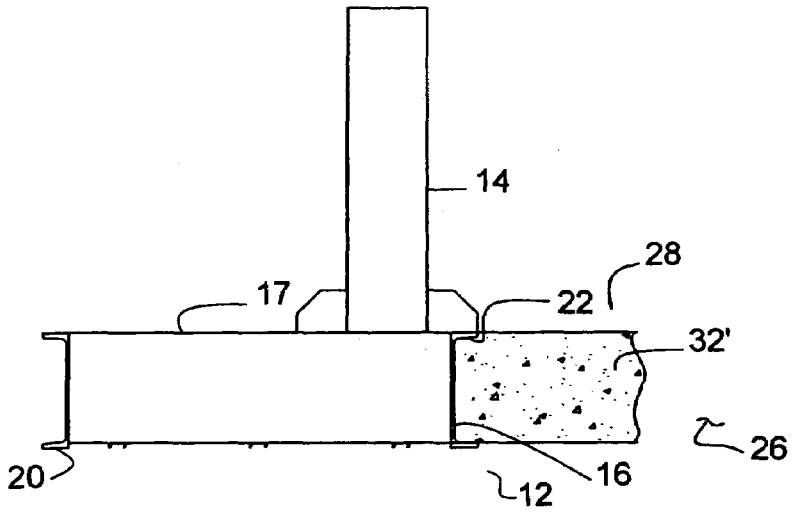
FIG. 3 is a view similar to FIG. 2 with a concrete addition to the thrust block frame of FIG. 2.

There is shown in FIG. 1 a vehicle barrier system 10 according to this invention including a reaction mass 12 for installation in the earth and at least one post 14 immovably anchored in reaction mass 12 and extending upwardly therefrom. Reaction mass 12 includes a forward member 16 for confronting and compressing the surrounding earth and absorbing energy from the impact of the vehicle 18 with post 14. Typically reaction mass 12 extends rearwardly 20 sufficiently from post 14 to be under at least the forward portion of the vehicle where it may bear a portion of the weight of the vehicle. Post 14 may be closer to the forward end 22 than the rearward end 20. Reaction mass 12 has depth d of approximately 15 inches and in FIG. 1 its top 17 is shown flush with the surface 24. The portion of the earth 26 immediately in front of forward member 16 is preferably virgin earth which is already naturally compacted to provide good resistance against any movement of reaction mass 12. The size and weight of reaction mass 12 and post 14 combined with the resistance of the earth 26 makes it possible for vehicle barrier system 10 to operate effectively to arrest the movement of vehicles even though it requires installation to only a depth of 21 inches. Reaction mass 12 may be formed from steel shapes as explained hereinafter and may include an additional thrust block 28, FIG. 2, including frame 29 made of steel shapes which may additionally include concrete 31. In that case the forward member, for purposes of confronting and compressing the earth, may now be constituted by the forward portion of frame 29 and any exposed concrete 32 associated with it. Post 14 is typically made of steel and may be solid steel or may be a steel cylinder 30 filled with a strong dense material such as concrete 32 for example. Also as shown in FIG. 2, reaction mass 12 had its top 17 not flush but below the surface 24 of the earth. Thrust block 28, FIG. 3, may be further formed by a mass of concrete 32' poured in and around frame 29 not visible in FIG. 3. The additional concrete 32' poured in situ may now become the forward member for confronting and compressing the earth.

Figure 3A:
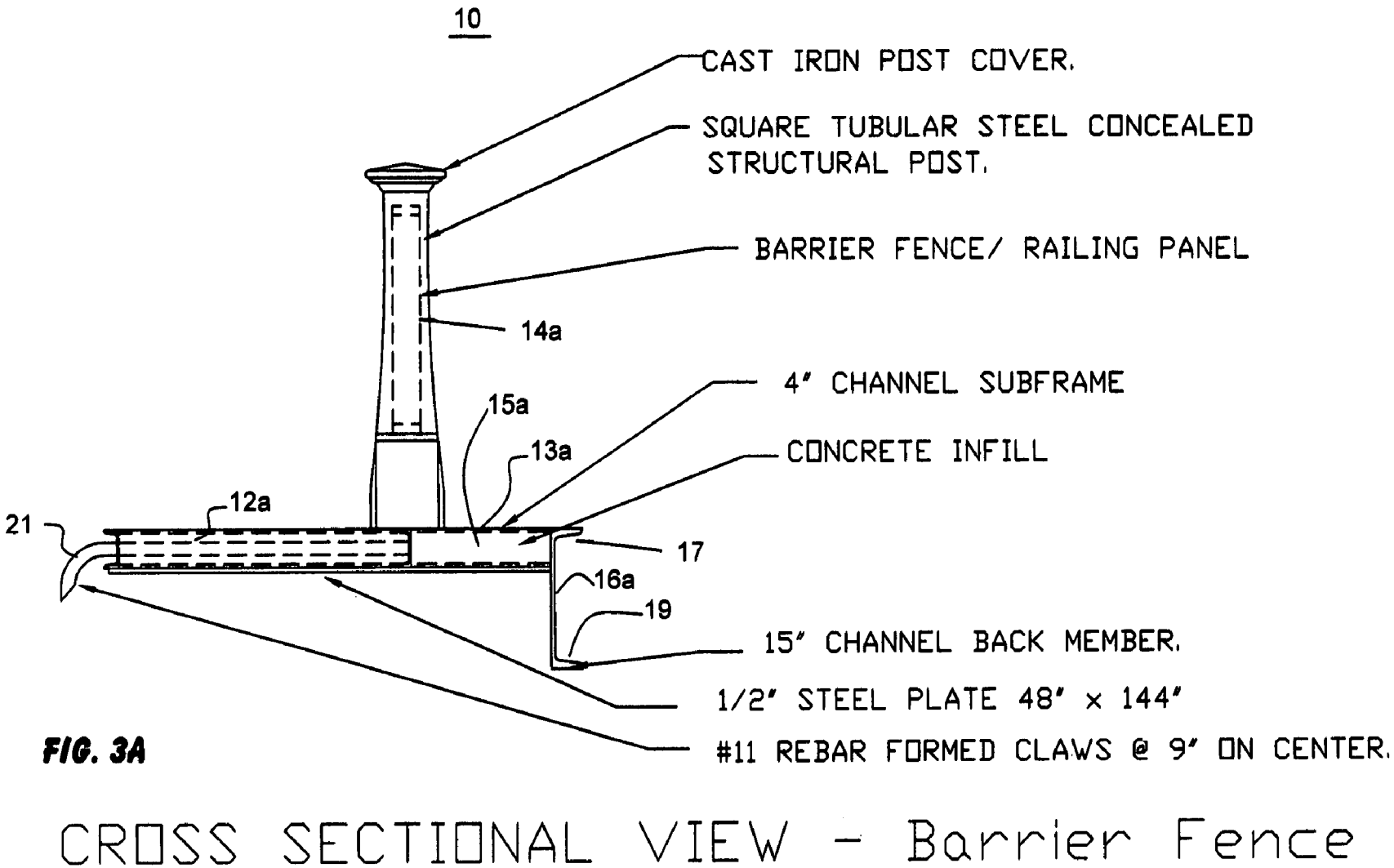
FIG. 3A is a schematic side elevational view of a rolling claw implementation of the vehicle barrier system of this invention.

In another construction, system 10*a*, FIG. 3A, may include a reaction mass 12*a* and post 14*a*. Forward member 16*a* may include distal portions 17, 19 and reaction mass 12*a* may include a channel subframe 13*a* which may be filled with concrete 15*a*. Channel subframe 13*a* may be four inches thick or deep while forward member 16*a* may be fifteen inches deep. There may also be claws 21 such as formed from rebar. The notion is that if a vehicle could hit bollard or post 14*a* with sufficient force to lift the system 10*a*, it would cause reaction mass 12*a* to rotate upward about forward member 16*a* and expose claws 21 to grip and hold on the under parts of the vehicle. The proposed rotation (shown without the vehicle for simplicity) is depicted in FIGS. 3B, C and D.

Figure 4:
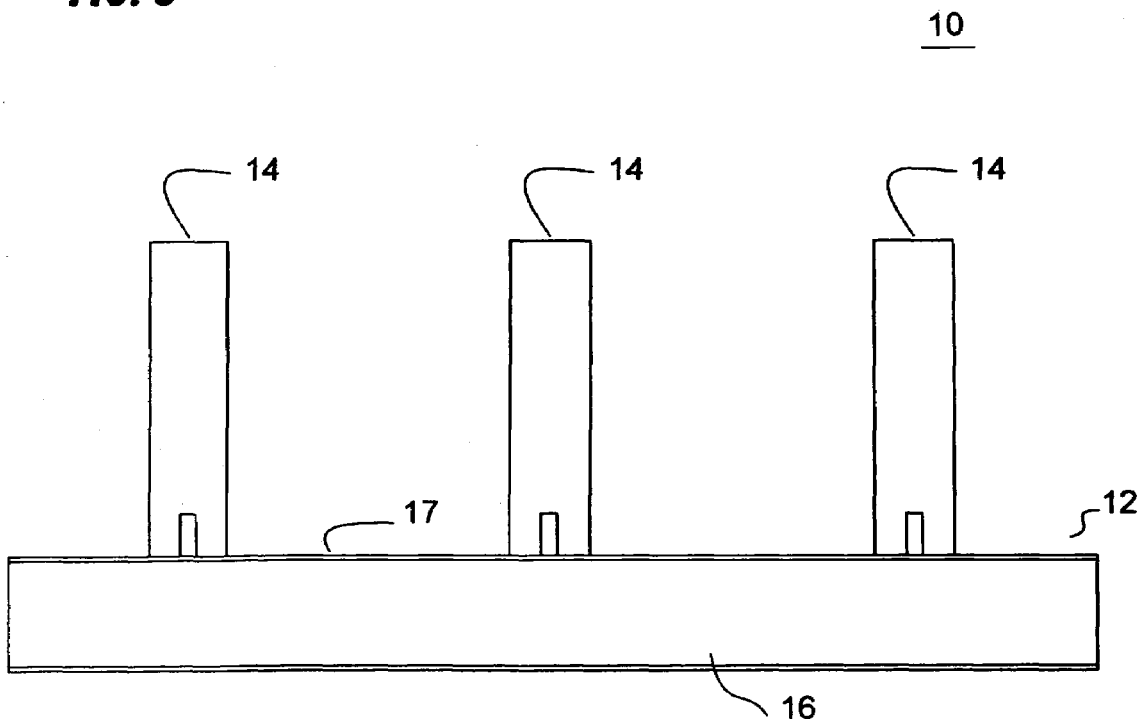
FIG. 4 is a schematic front elevational view of the vehicle barrier system of FIG. 1 showing a module with three posts immovably mounted to the reaction mass frame.
Figure 3E:
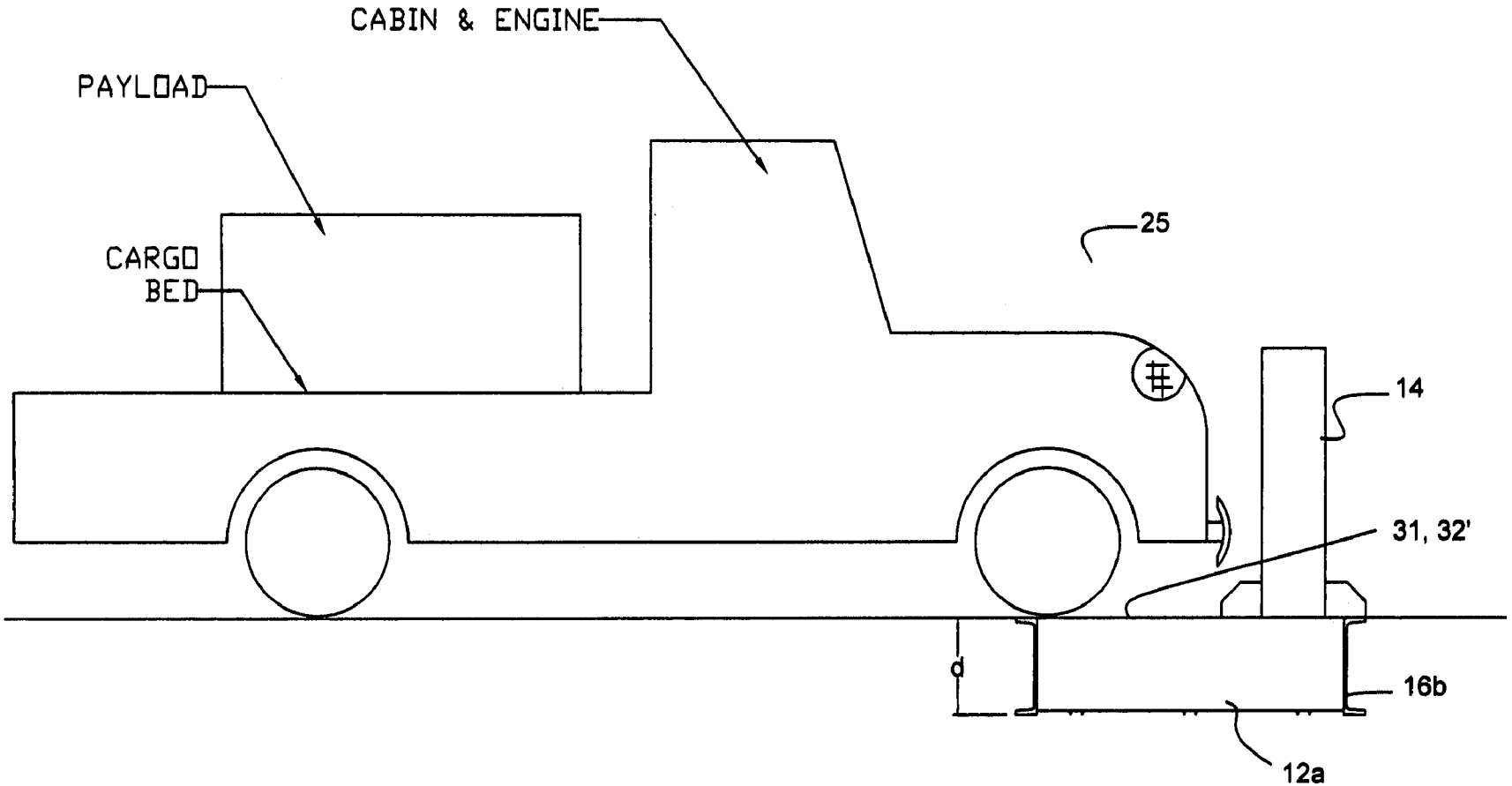
FIG. 3E and F are schematic diagrams of a reaction mass whose front surface implements the forward member.
Figure 3F:
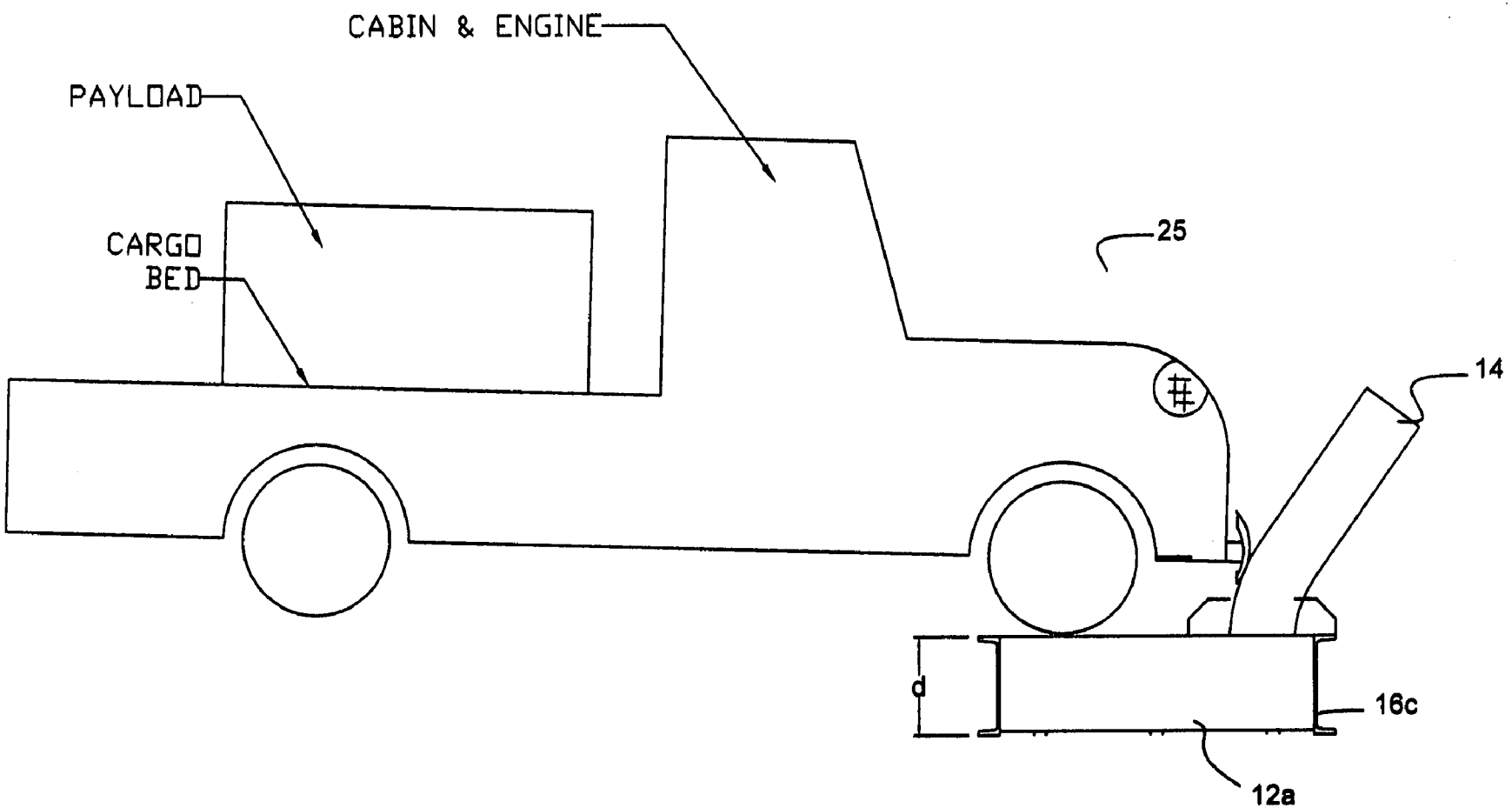
FIG. 3B-D are views of the system of FIG. 3A depicting its proposed rotation upon vehicle impact.
FIG. 3G is a side section elevational view of a system according to this invention with an integrated continuous thrust block whose forward surface implements the forward member.
Figure 3C:
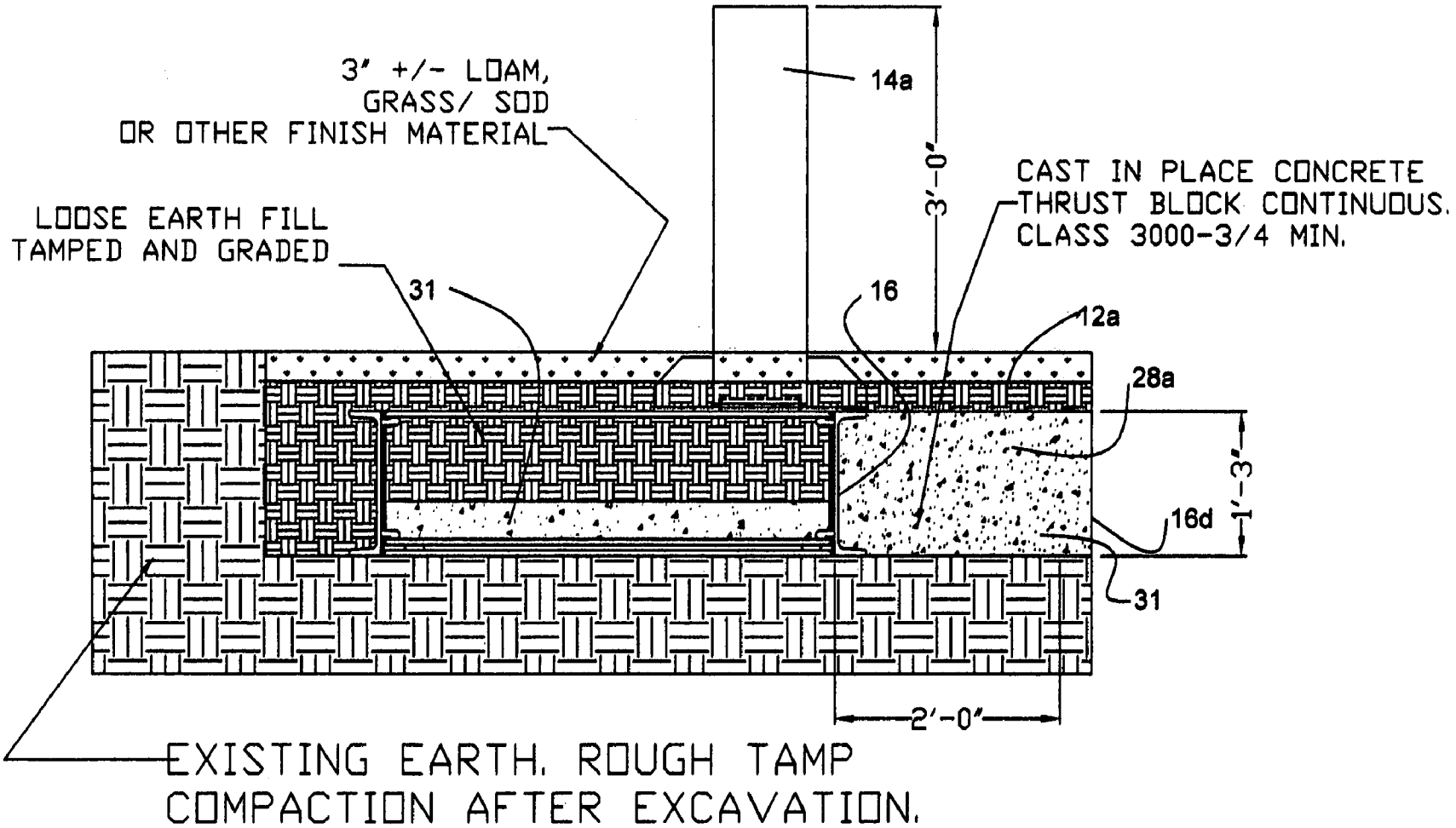
Figure 5:
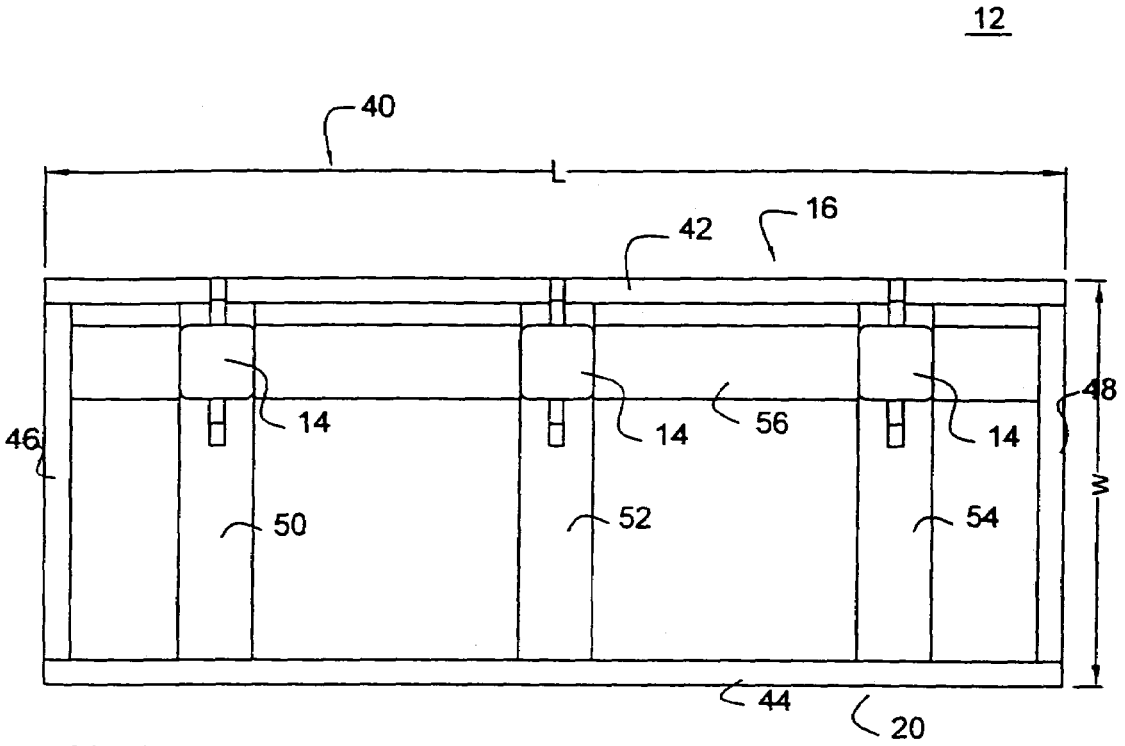
FIG. 5 is a schematic top plan view of the barrier system of FIG. 4.

If rotation is not a consideration, as in FIGS. 3E, F, the forward member can be simply the forward surface 16*b*, 16*c*, of the concrete either in, 31, or about, 32', reaction mass 12*a*. In FIGS. 3E and F the vehicle is shown only schematically at 25. In FIG. 3G thrust block 28*a* is integral and continuous with the reaction mass 12*a* and so the original forward member 16 is embedded in reaction mass 12*a* and the surface 16*d* of the thrust block 28*a* becomes the forward member. All of these systems disclosed hereinabove and following may have depths of a few inches up to 21 inches (K12 Department of State standards) or more. Although thus far vehicle barrier system 10 is shown in side view depicting but one post 14, this is not a necessary limitation of the invention, for as shown in FIG. 4, vehicle barrier system 10 may include a plurality of such posts 14 attached to reaction mass 12. Frame 40 of reaction mass 12, FIG. 5, may be formed of steel shapes including but not limited to forward channel 42 and rearward channel 44, which are 15 inches high and 3.375 inches wide and have a weight of 33.9 pounds per linear foot. End channels 46 and 48 may be made of similar channel material and there may be cross-beams 50, 52, and 54. Lateral stabilizer 56 may be made of a "T" shape with a height of 6 inches, a width of 10 inches, and a weight of 26.5 pounds per linear foot. I-beams having a height of 14 inches, a width of 10 inches and a weight of 61 pounds per linear foot. The entire frame has a length l equal to 137½ inches and a width w equal to 48.625 inches and an overall weight including frame 40 and bearing post 14 of 4,700 pounds. Also included may be ½ inch steel plate bottom and channel "grabbers".

Figure 6:
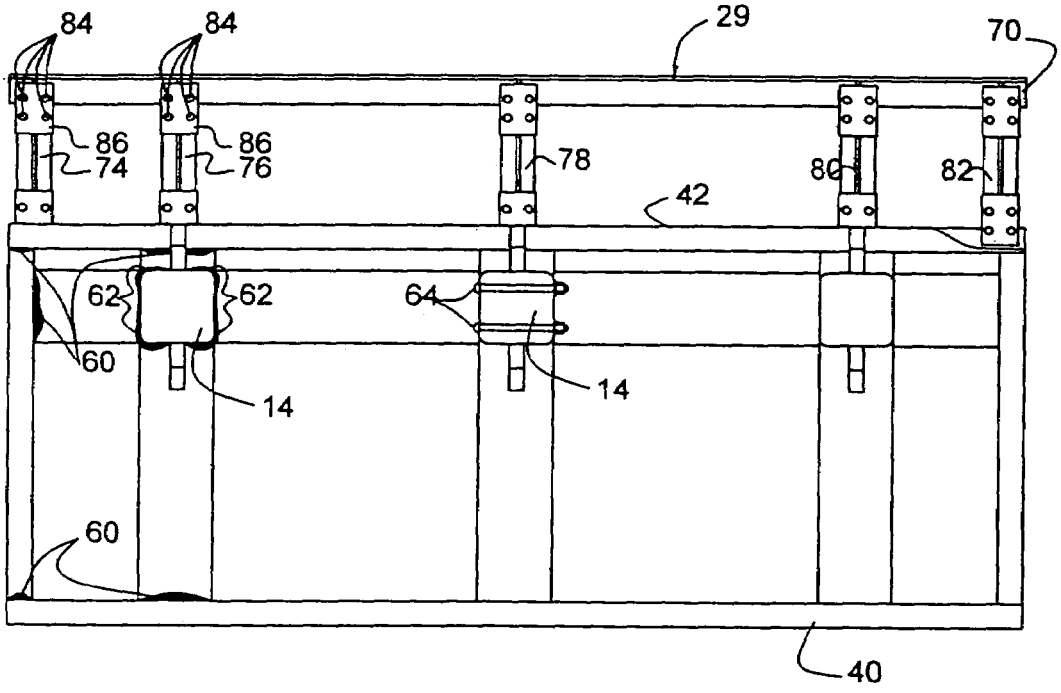
FIG. 6 is a view similar to FIG. 5 with the addition of the thrust block frame to the reaction mass frame of FIG. 5.
Figure 6A:
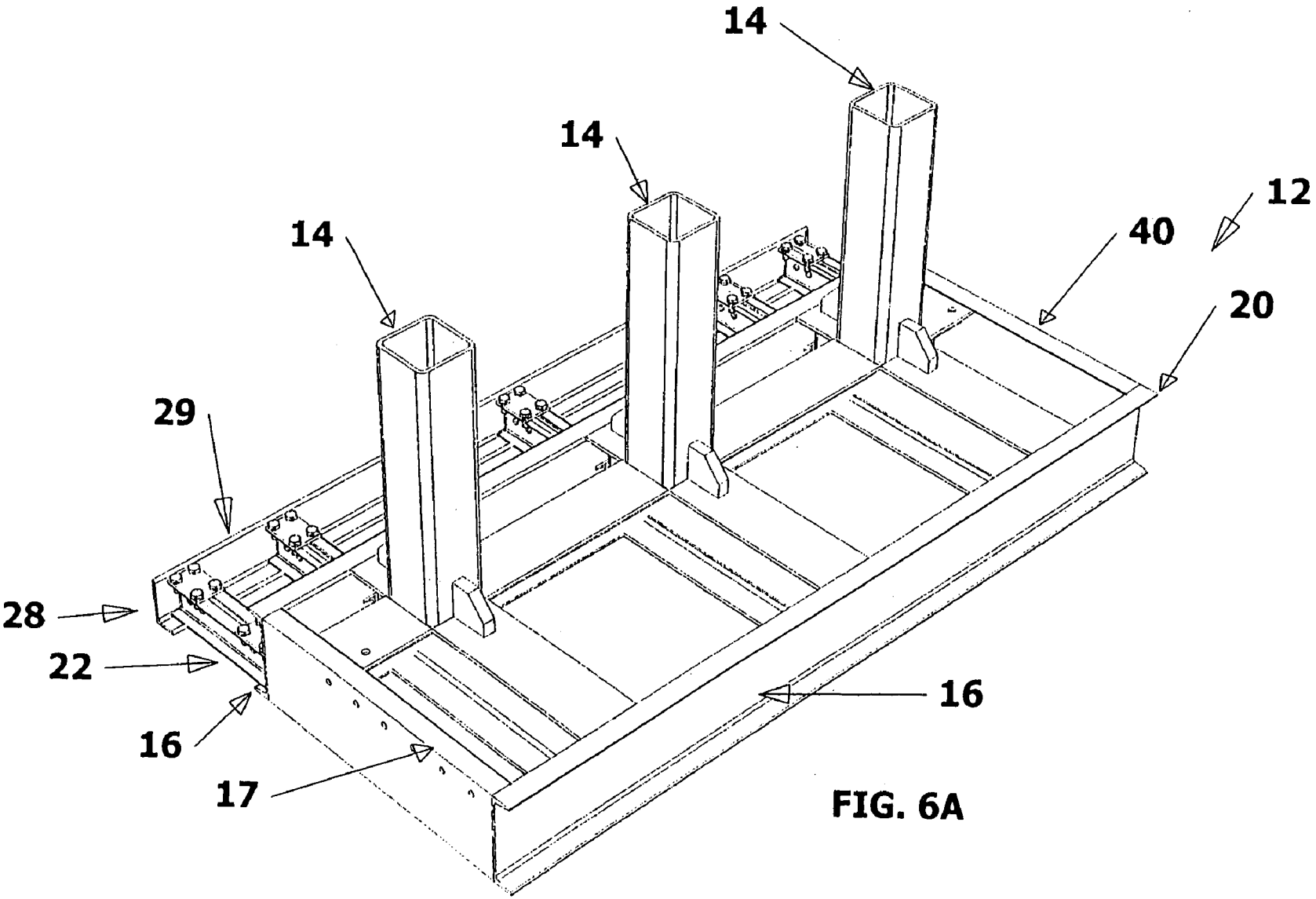
FIG. 6A is a three dimensional view of the system of FIG. 6.

All of the beams, 42-56 may be fastened in any suitable fashion, e.g., bolts, welding. In FIG. 6, beams 42-56 are shown welded to each other such as at welds 60, but this could as well be done by high strength bolts. This is illustrated with respect to thrust block frame 29 in FIG. 6, where longitudinal L angle 70, 42 are attached to the cross channels 74, 76, 78, 80 and 82 by means of bolts 84 and connector plates 86. Angle 70, has a height of 8 inches and a width of 4 inches and a weight of 19.6 pounds per linear foot. Channels 74-82 have a height of 6 inches a width of 2 inches and a weight of 10.5 pounds per linear foot. Either or both reaction mass frame 40 and thrust block frame 29 may use welds, bolts or any other suitable fastening technique as indicated earlier. Likewise, posts 14 are immovably anchored to frame 40 in reaction mass 12 by a suitable strong attachment means. For example, welds 62 or by bolts 64. I-beams 74-82 typically have a length of 22 inches so that the thrust block frame 29 adds approximately 2 feet to the width w of reaction mass frame 40. A better understanding of reaction mass 12 with frame 40, posts 14 and thrust block frame 29 is afforded by the three dimensional view of FIG. 6A.

Figure 7:
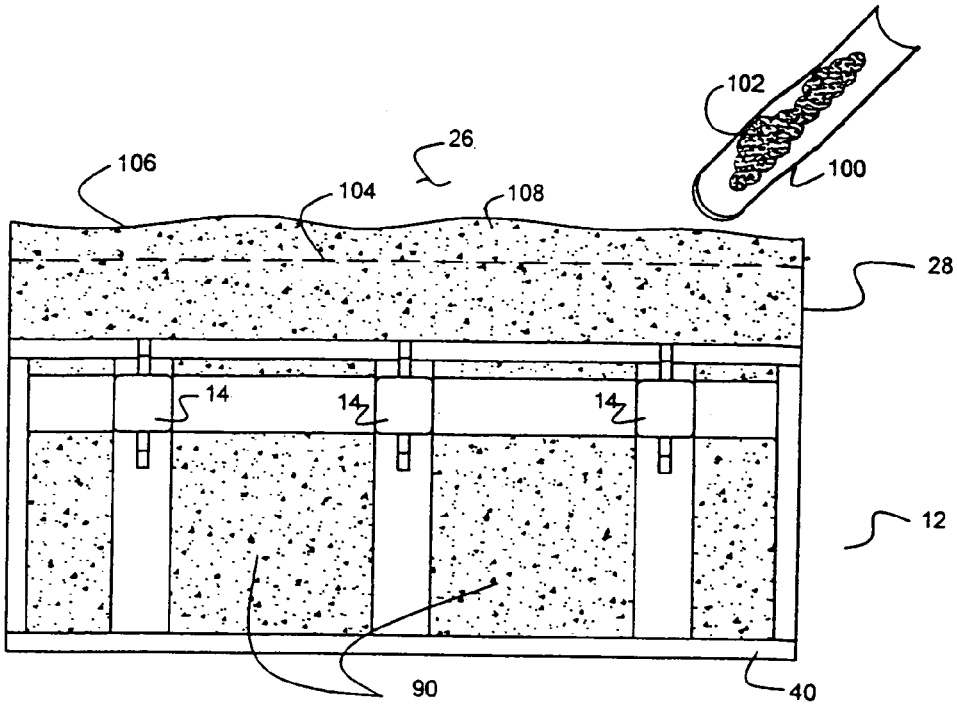
FIG. 7 is a view similar to FIG. 6 with concrete installed in the reaction mass frame and the thrust block frame with an additional in situ pour against virgin earth.

Reaction mass 12 frame 40, FIG. 7, may be filled with a strong dense material such as concrete 90, FIG. 7, having a density of approximately 144 pounds per cubic foot so that the overall modular reaction mass including frame 40 and concrete 90 with posts 14 weighs approximately 12,235 pounds. Concrete 90 may be supplied initially and shipped as a part of the module or may be filled in situ. Thrust block 28 may also have the concrete portion poured at the factory where the module is made or in situ as shown by shute 100 delivering concrete 102 on site. If thrust block 28 is made previously and shipped to the site as a part of reaction mass 12 it is typically not practical to make the trench in which system 10 modules are installed with clean sharp edges that will just fit the edge of the thrust block 28 so that the thrust block will be up against virgin naturally compressed soil. For this reason more concrete 102 will be added in situ so that the space between the edge 104 of thrust block 28 and the irregular edge 106 of the earth of the trench will be filled with a minimally compressible material such as the concrete 108 which then engages the virgin earth 26. Of course if the concrete portion of thrust block 28 is not made previously and shipped with reaction mass 40, then the entire assembly of thrust block plus the fill portion 102 can be poured at one in the same time.

One of the important advantages of this invention in addition to the fact that it requires less ground preparation and can be shallow ground mounted is the fact that it admits of easy and aesthetic variations in design and appearance. And in fact it is easily integrated in common landscape items referred to as hardscape, such as park benches, bus waiting shelters, vehicle gates, pedestrian gates, street lighting, fountains, civic arts and sculpture, trash receptacles, tables, chairs, and other exterior elements which can both disguise and beautify the installation and can increase the vehicle arresting function of the barrier system.

Figure 8:
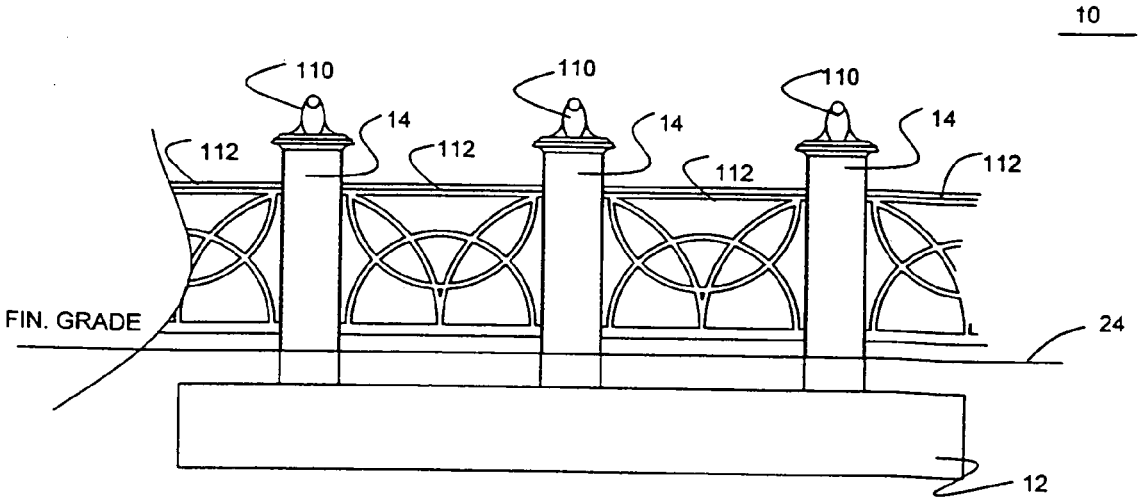
FIG. 8 is a schematic front elevational view of a vehicle barrier system according to this invention associated with hardscape objects in the surrounding environment.
Figure 9:
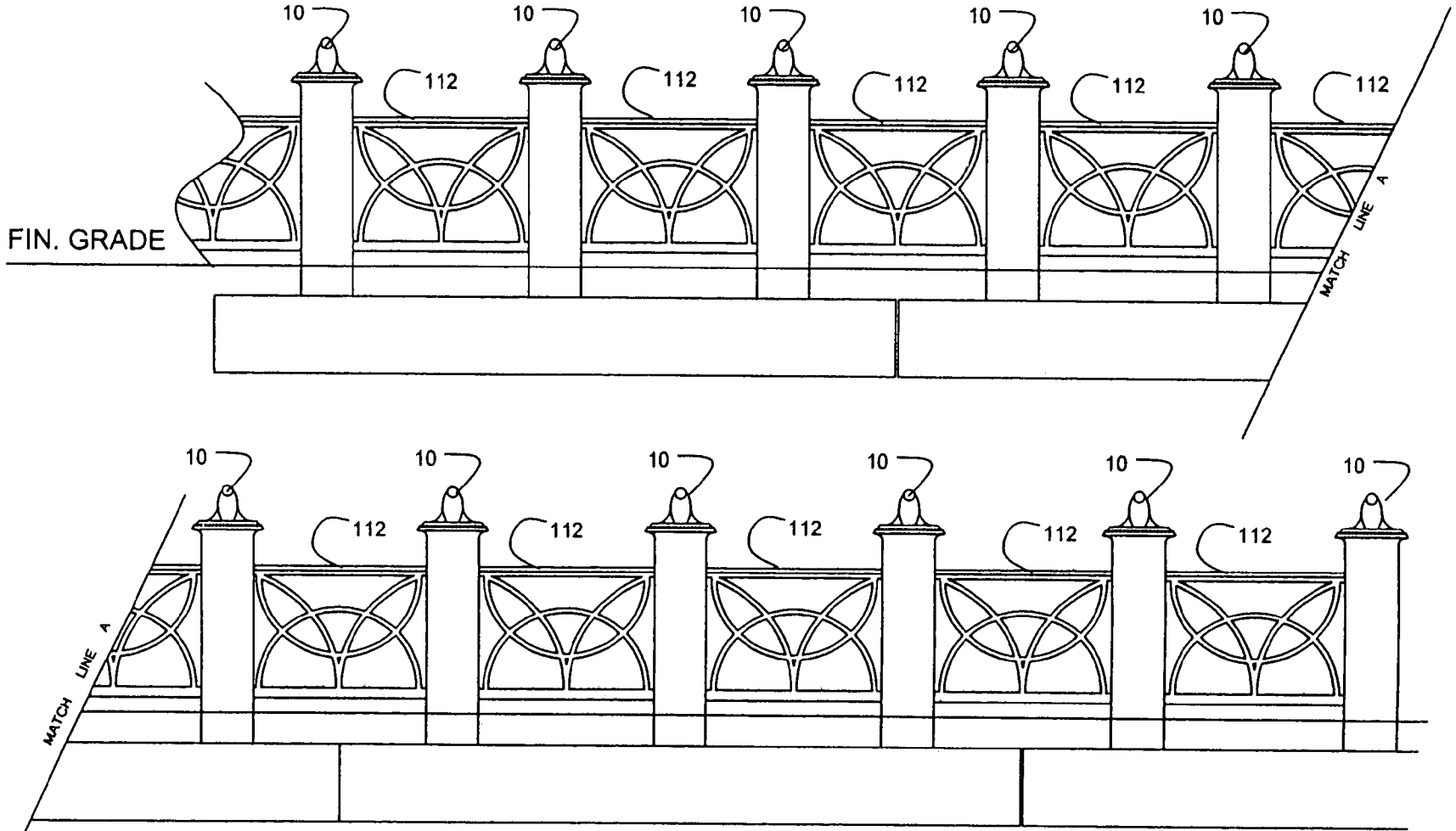
FIG. 9 is a view similar to FIG. 8 showing a series of such vehicle barrier systems interconnected to form a continuous hardscape object such as a fence.
Figure 10:
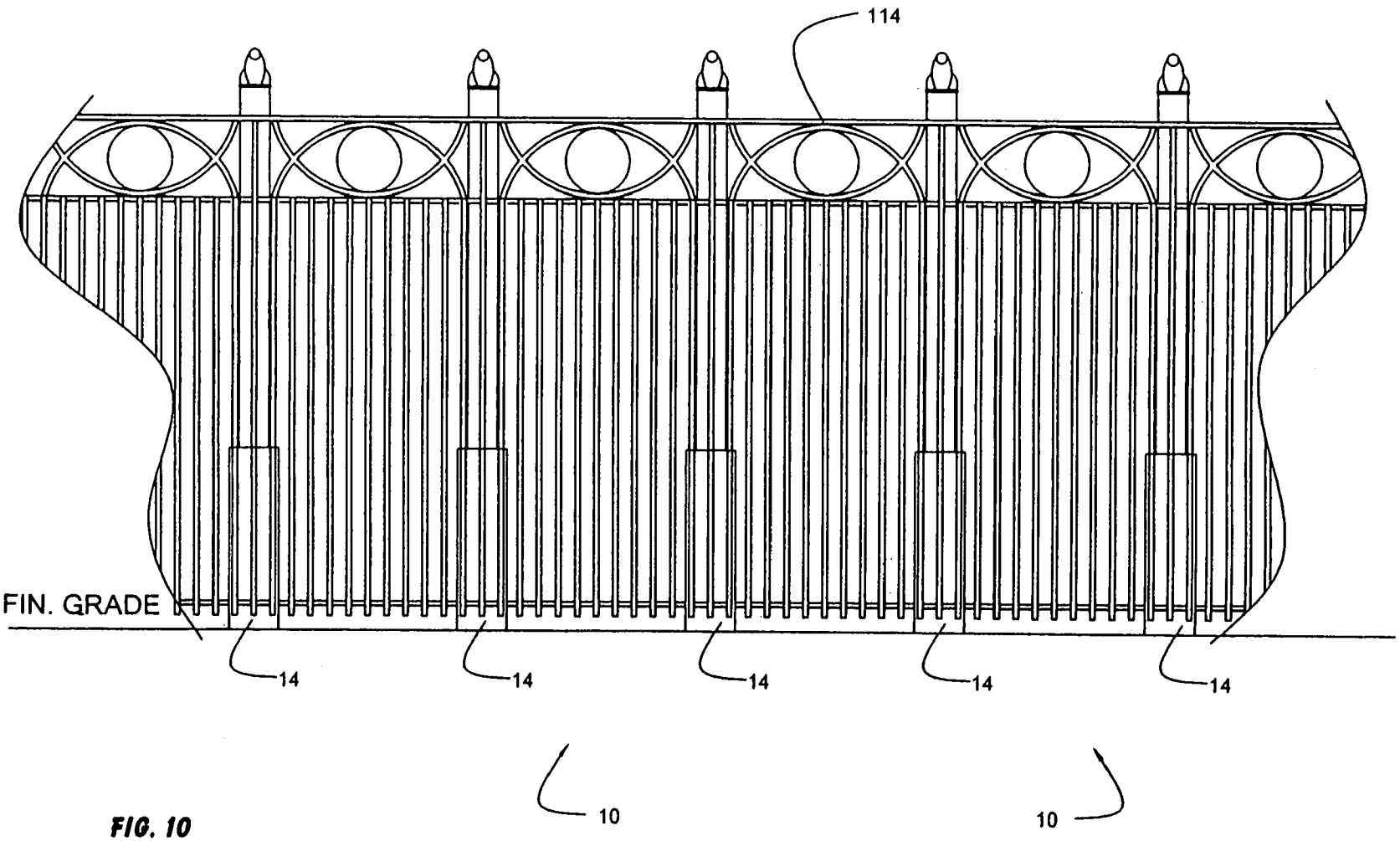
FIG. 10 is a front elevational view of a 9' high anti-climb fence with which the posts of the vehicle barrier system of this invention are integral.
Figure 11:
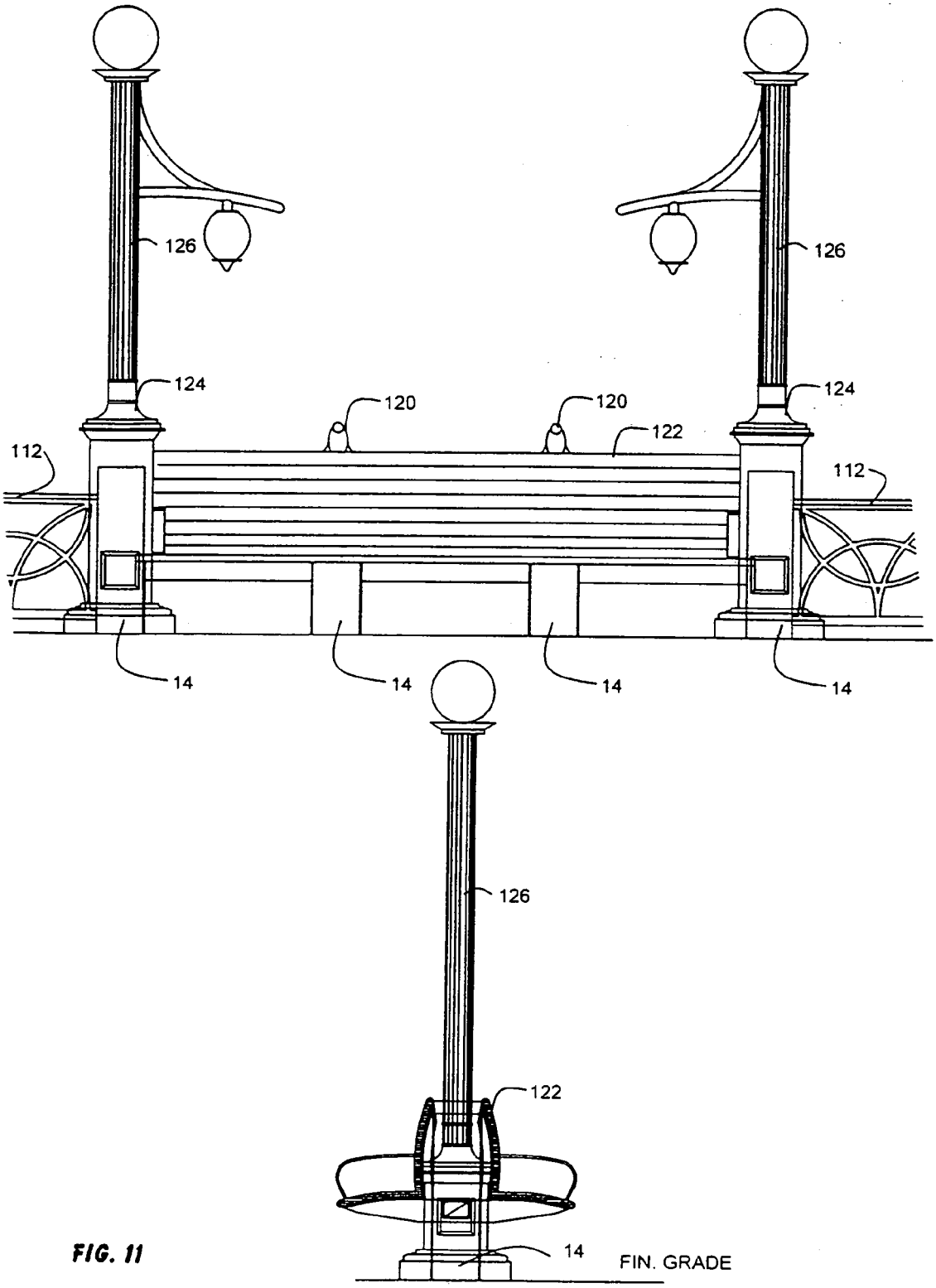
FIGS. 11 and 12 are views similar to FIGS. 8, 9, and 10 showing various hardscape object environments with which the vehicle barrier system of this invention may be associated and/or integrated.
Figure 12:
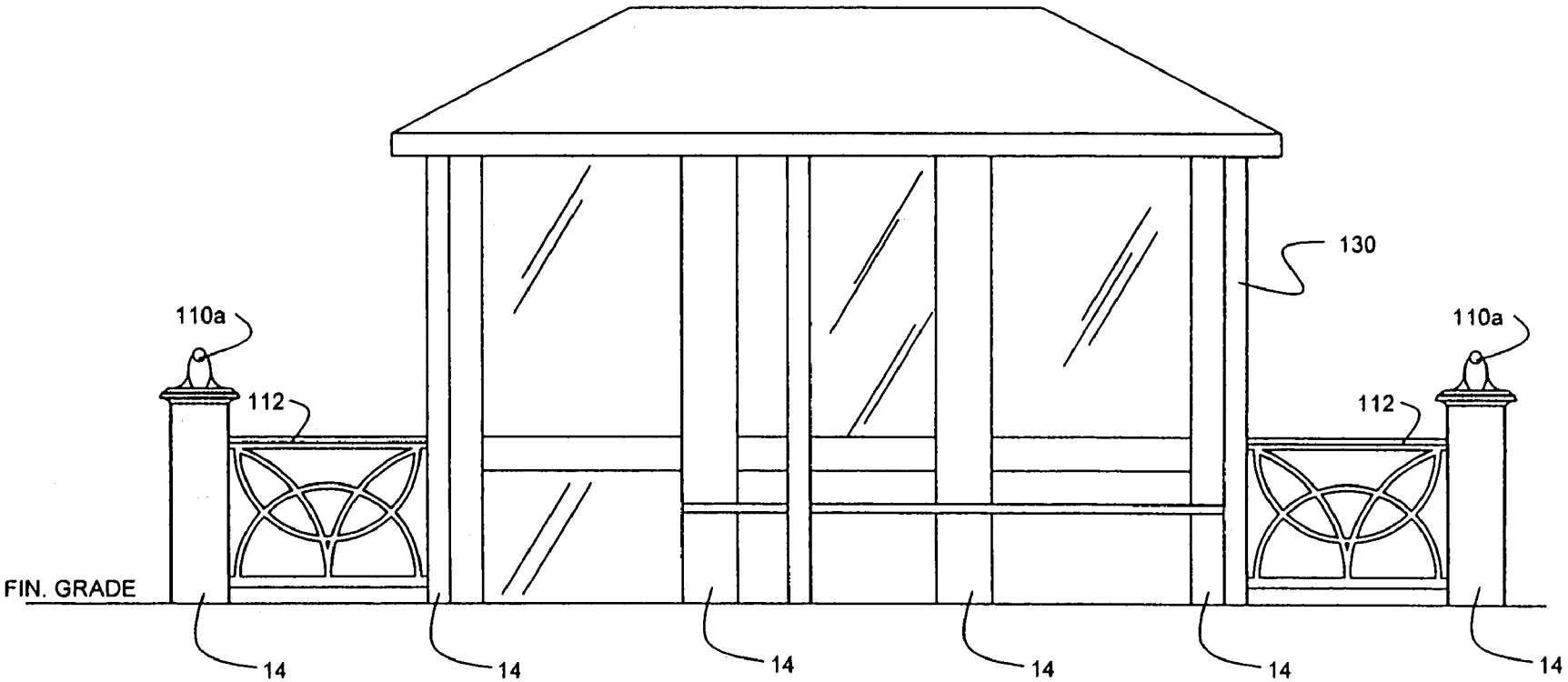

For example, posts 14, FIG. 8, may be covered by architecturally designed fence posts 110 which are further integrated into railing panels 112. Systems 10 of three posts 14 each, FIG. 9, laid in an extensive trench 21 inches deep and 6 feet wide may use connecting rail panels 112 to be made to appear as one continuous decorative fence wholly appropriate to the landscape and completely disguising the barrier system. Various other integrations are possible in which the vehicle barrier system according to this invention is associated with or form a part of the hardscape environs or is integral with the hardscape objects. FIG. 10 shows a 9' high anti-climb fence 114, such as used around an embassy or other public building, of substantial height and length and mounted to and supported by posts 14 which are immovably anchored in the reaction masses of their respective or common barrier systems 10. Although the embodiments herein have been shown as having one or three posts these are not limitations of the invention as any number is workable depending upon the constraints of shipment, handling, ease of installation and size of vehicles to be blocked. Typically, when there is more than one post there are spaced at approximately 46 inches apart. Posts 14 in addition to being disposed in designer posts 110*a*, FIG. 11 may be made as a part of supports 120 for park bench 122 or may be disposed in the bases 124 of various light posts 126 or even as a part of structures and buildings such as bus waiting shelter 130, FIG. 12, where post 14 can be wholly integrated in the hardscape objects and the presence of the barrier system including each of the barrier system modules is wholly disguised.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A modular vehicle barrier system comprising:

a reaction mass including a metal frame for installation in the earth, the frame at least partially filled with concrete in situ and including:

a plurality of cross beams; and at least one lateral member connecting the plurality of cross beams; and a plurality of spaced bollards immovably anchored in said reaction mass and extending upwardly therefrom;

said reaction mass having a metal forward member for confronting and compressing the surrounding earth and absorbing energy from the impact of the vehicle with one or more bollards.

2. The modular vehicle barrier system of claim 1 in which said forward member includes distal portions proximate its lower and upper ends.

3. The modular vehicle barrier system of claim 1 in which said reaction mass includes at least one claw proximate its rearward end for engaging an impacting vehicle upon rotation of said reaction mass.

4. A modular vehicle barrier system comprising:

a reaction mass including a metal frame for installation in the earth, the frame at least partially filled with concrete in situ and including:

a plurality of cross beams; and at least one lateral member connecting the plurality of cross beams; and a plurality of spaced bollards immovably anchored in said reaction mass and extending upwardly therefrom;

said reaction mass having a concrete forward member for confronting and compressing the surrounding earth and absorbing energy from the impact of the vehicle with one or more bollards.

5. The modular vehicle barrier system of claim 4 in which said forward member includes the forward surface of said reaction mass.

6. The modular vehicle barrier system of claim 5 in which said forward surface includes at least some pre-cast concrete.

7. The modular vehicle barrier system of claim 5 in which said forward surface includes at least some concrete poured in situ.

8. The modular vehicle barrier system of claim 4 in which said reaction mass includes at least one claw proximate its rearward end for engaging an impacting vehicle upon rotation of said reaction mass.

9. The modular vehicle barrier system of claim 4 in which said reaction mass extends rearwardly from said post under at least the forward portion of the vehicle for bearing a portion of the weight of the vehicle.

10. The modular vehicle barrier system of claim 4 in which said bollards are closer to the forward end than the rearward end of said reaction mass.

11. The modular vehicle barrier system of claim 4 in which said bollards are made of metal.

12. The modular vehicle barrier system of claim 4 in which said bollards are made of metal and filled with concrete.

13. The modular vehicle barrier system of claim 4 in which said metal framework includes metal members welded or bolted together.

14. The modular vehicle barrier system of claim 13 in which said bollards are made of metal and are welded to said frame.

15. The modular vehicle barrier system of claim 4 in which said reaction mass includes a thrust block at its forward end.

16. The modular vehicle barrier system of claim 15 in which said thrust block includes a metal core.

17. The modular vehicle barrier system of claim 15 in which said thrust block includes a concrete forward member extending to confronting virgin earth.

18. The modular vehicle barrier system of claim 17 in which said thrust block includes a concrete mass poured in situ.

19. The modular vehicle barrier system of claim 4 in which the top of said reaction mass is below the surface.

20. The modular vehicle barrier system of claim 4 in which the top of said reaction mass is flush with a surface of the earth.

21. The modular vehicle barrier system of claim 4 in which the system is accompanied with hardscape environs and said posts form a part of the hardscape environs.

22. The modular vehicle barrier system of claim 4 in which the system is accompanied with hardscape objects and said posts are integral with the hardscape objects.

23. A modular vehicle barrier system comprising:

a plurality of spaced bollards; and a reaction mass having a forward member for confronting and compressing the surrounding earth and absorbing energy from the impact of the vehicle with one or more of said bollards, said reaction mass including a metal frame for installation in the earth and at least partially filled with concrete in situ, said metal frame including:

a plurality of cross beams each welded to one of said spaced bollards to immovably anchor the bollards in said cross beams, said bollards extending upwardly from the corresponding cross beams; and one or more lateral members connecting the plurality of cross beams.

24. A modular vehicle barrier system comprising:

a plurality of spaced bollards; and a reaction mass having a thrust member for confronting and compressing the surrounding earth and absorbing energy from the impact of the vehicle with one or more of said bollards, said reaction mass and forward member including a metal framework for installation in the earth and at least partially filled with concrete in situ, said metal framework including:

a plurality of cross beams each bolted to one of said spaced bollards to immovably anchor the bollards in said cross beams, said bollards extending upwardly from the corresponding cross beams; and one or more lateral members connecting the plurality of cross beams.

* * * * *